US006488252B1

(12) United States Patent
Ibrahim

(10) Patent No.: US 6,488,252 B1
(45) Date of Patent: Dec. 3, 2002

(54) PROCESS FOR MAKING FOLDABLE, PORTABLE BOOKSTAND

(76) Inventor: Zafar Y. Ibrahim, 7923 Leschi Rd., SW., Lakewood, WA (US) 98498

( * ) Notice: Subject to any disclaimer, the term of this patent is extended or adjusted under 35 U.S.C. 154(b) by 0 days.

(21) Appl. No.: 09/928,003

(22) Filed: Aug. 13, 2001

(51) Int. Cl.[7] ..... A47B 97/04
(52) U.S. Cl. ..... 248/460; 248/441.1
(58) Field of Search ..... 248/346.3, 441.1, 248/447, 460, 462, 150

(56) References Cited

U.S. PATENT DOCUMENTS

| | | | | | |
|---|---|---|---|---|---|
| 581,098 | A | * | 4/1897 | Berbecker | 248/460 |
| 1,485,786 | A | * | 3/1924 | Kraft | 248/460 |
| 3,255,989 | A | * | 6/1966 | Risk | 248/460 |
| 4,163,497 | A | * | 8/1979 | McEwen | 211/11 |
| 4,267,998 | A | * | 5/1981 | Weirich | 248/165 |
| 4,467,991 | A | * | 8/1984 | Bailes | 248/447.1 |
| 4,996,404 | A | * | 2/1991 | Skerker et al. | 219/10.55 E |
| 5,102,088 | A | * | 4/1992 | Ramani | 248/460 |
| 5,197,612 | A | * | 3/1993 | Thompson | 211/74 |

* cited by examiner

*Primary Examiner*—Ramon O. Ramirez
*Assistant Examiner*—Kofi Schulterbrandt
(74) *Attorney, Agent, or Firm*—Richard L. Huff

(57) ABSTRACT

A process of making a foldable, portable bookstand on which readers may place their reading material. When folded, the bookstand appears to be a single oblong piece. When unfolded, the side view of the bookstand resembles the letter "X". The bookstand is made from two top pieces and two bottom pieces. The spine of a book may be placed along a space between top pieces. The bookstand is made by providing two bottom pieces having tapered extensions and two top pieces having tapered extensions and adjoining the extensions of corresponding bottom and top pieces, preferably with dowels. The advantage of the present invention is that the bookstand may be simply and economically made of four separate pieces using dowels, yet maintain the appearance of a product which has been carved from a single piece of material.

4 Claims, 3 Drawing Sheets

PROCESS FOR MAKING FOLDABLE, PORTABLE BOOKSTAND

BACKGROUND OF THE INVENTION

1. Field of the Invention

This invention relates to a foldable portable bookstand which is made by attaching four pieces of material together so as to form two identical oblong sections which interlock with each other. The resulting two sections may be folded together for easy transport and storage or may be unfolded to form a bookstand having a side view resembling the letter "X".

2. Description of the Related Art

From ancient times, it has been known to prepare foldable, portable bookstands with a side view resembling the letter "X". These bookstands, known as rahels, historically have been used to protect holy books from being placed on the ground or floor. From the beginning of their manufacture until the present invention a bookstand of this type has been made of a single piece of wood which was cut and carved to have the desired qualities and appearance. This process is manual labor intensive and is not adapted to placing affordable bookstands on the market.

SUMMARY OF THE INVENTION

The present invention allows for the production of large quantities of bookstands of beauty and strength at prices which are affordable to the ordinary consumer. The present invention is directed to the manufacture of foldable, portable bookstands from four pieces of material as opposed to a single piece of material as has been done in the prior art.

To accomplish the manufacture of a bookstand according to the present invention, four pieces of material are cut, designed and finished so as to form two bottom pieces and two top pieces. Two bottom pieces are arranged in the way they will be in the final product. Next, the two top pieces are connected to the two bottom pieces by dowels to form a final interlocking assemblage having a first top and bottom combination interlocked with a second top and bottom combination. The final interlocking assemblage may be folded in such a manner as to take up little space for ease in transporting. When desired, the final interlocking assemblage may be unfolded to create a bookstand having a side view resembling the letter "X".

DESCRIPTION OF THE PREFERRED EMBODIMENTS

Figure 1:
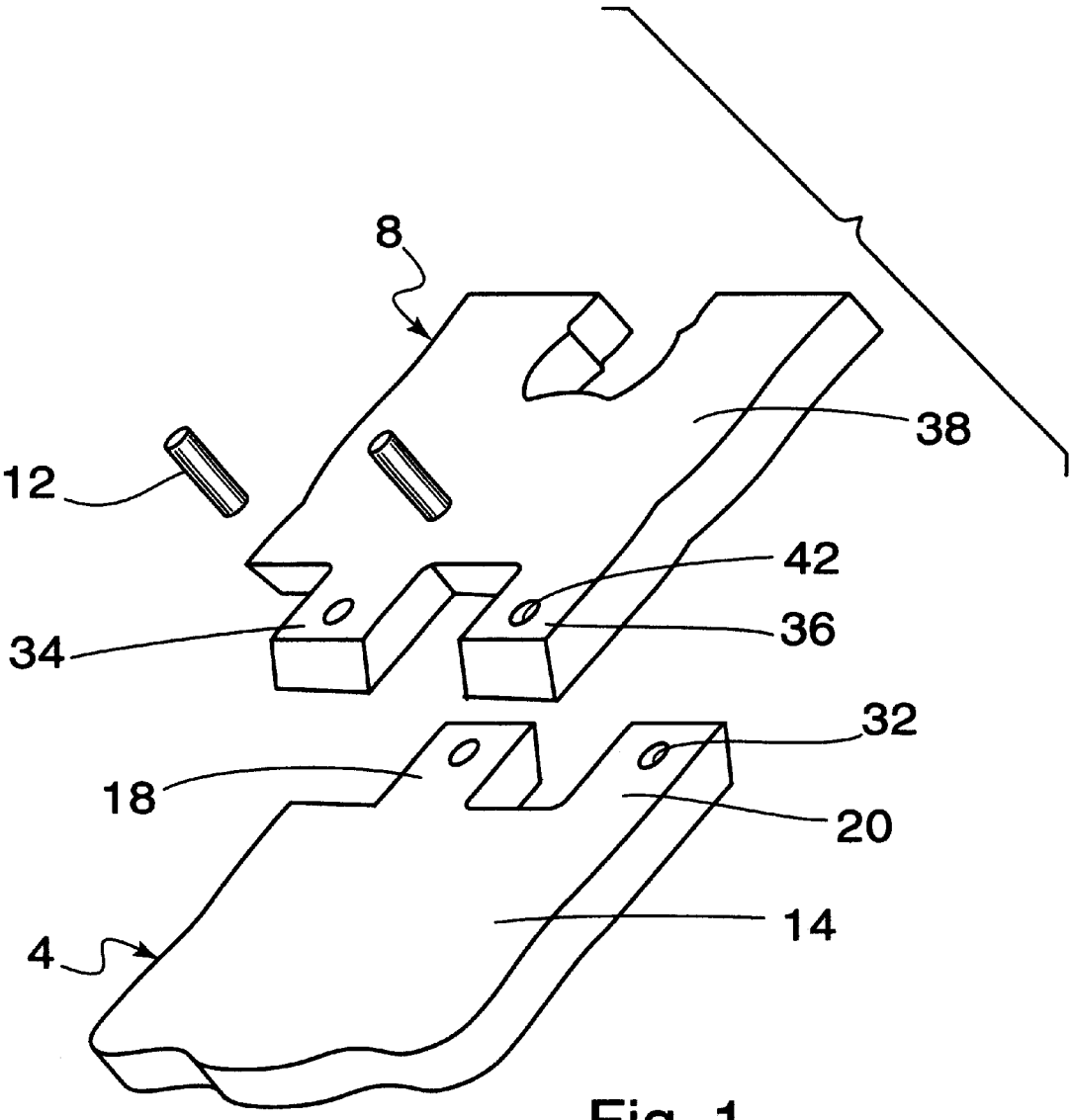
FIG. 1 is an exploded perspective view showing how a top piece and a bottom piece will be joined together with dowels.

The final product of the process of the present invention is a foldable, portable bookstand 2. The bookstand 2, itself, has been known since ancient times and has been used to support holy books. The prior art bookstand, or rahel, was manufactured laboriously from a single piece of wood. The present invention allows for the quick and relatively easy manufacture of the bookstand 2 to enable the common consumer to afford one.

The materials used in the process of the present invention are a first 4 and second 6 top piece, a first 8 and second 10 bottom piece, and four joining devices, 12 preferably dowels, screws, or brads although glue may be used. The material from which the bookstand 2 is made may be wood, plastic, metal, or other suitable material.

With reference to FIGS. 1–4, the top pieces 4, 6 are subject to a variety of shapes and designs and the front 14 and back 16 surfaces thereof may be plain or ornate. The top pieces 4, 6 have first 18 and second 20 extensions which are tapered such that each front surface 14 is longer than the corresponding back surface 16. The degree of tapering is such that when the bookstand 2 is in its open position, the open area 22 between the front surfaces 14 of the top pieces 4, 6 will form a slight ridge 24 and the slopes 26 from the ridge 24 to the front surfaces 14 of the top pieces 4, 6 will be uniform from the first side 28 of the bookstand 2 to the second side 30. The first 18 and second 20 extensions may contain apertures 32 therethrough for the placement of dowels 12.

The bottom pieces 8, 10 may also take a variety of shapes and forms as well as degrees of decorativeness. The bottom pieces 8, 10 have first 34 and second 36 extensions which match the positioning of the first 18 and second 20 extensions of the top pieces 4, 6. The first 34 and second 36 extensions are tapered such that the front surface 38 is shorter than the corresponding back surface 40. The first 34 and second 36 extensions may contain apertures 42 therethrough for the placement of dowels 12.

Figure 2:
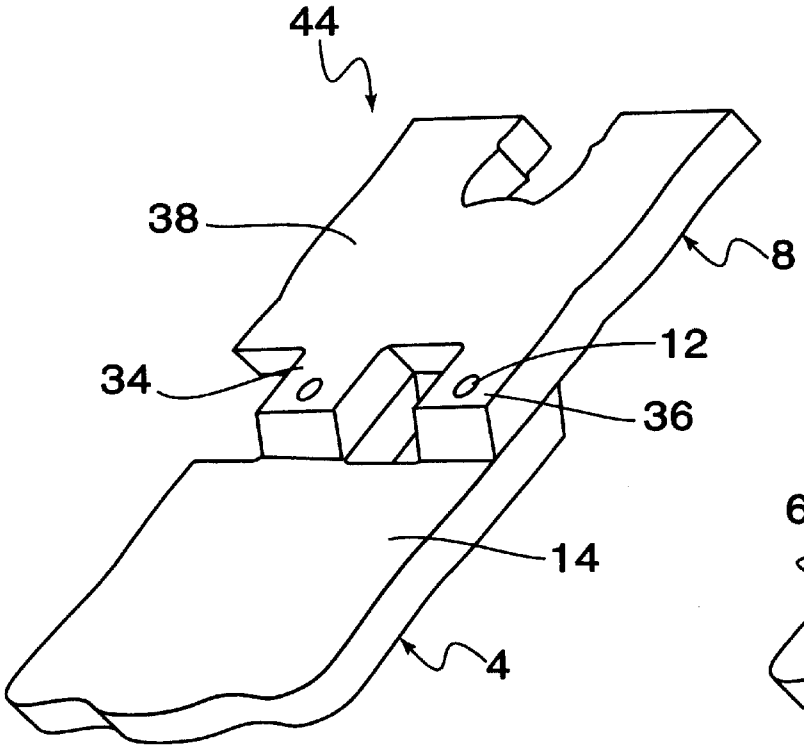
FIG. 2 is a perspective view showing a top and bottom combination.

For purposes of clarity, FIG. 2 shows how a single top and bottom combination 44 will appear when assembled. In practicing the process of this invention, however, a single top and bottom combination 44 is not assembled. In the assembly process, two bottom pieces 8, 10 are aligned so that their back surfaces 40 abut and their extensions 34, 36 alternately intermesh. Once the bottom pieces 8, 10 are in place, the corresponding top pieces 4, 6 may be put in place and attached to the bottom pieces 8, 10 by inserting the tightly fitting dowels 12 through the appropriate apertures 32, 42 or by other means of joining. The use of glue or water may be used to form a tight fit of the dowels 12 in the apertures 32, 42. When each top piece 4, 6 has been attached to its corresponding bottom piece 8, 10, the bookstand 2 is assembled and the bookstand 2 is complete.

Figure 3:
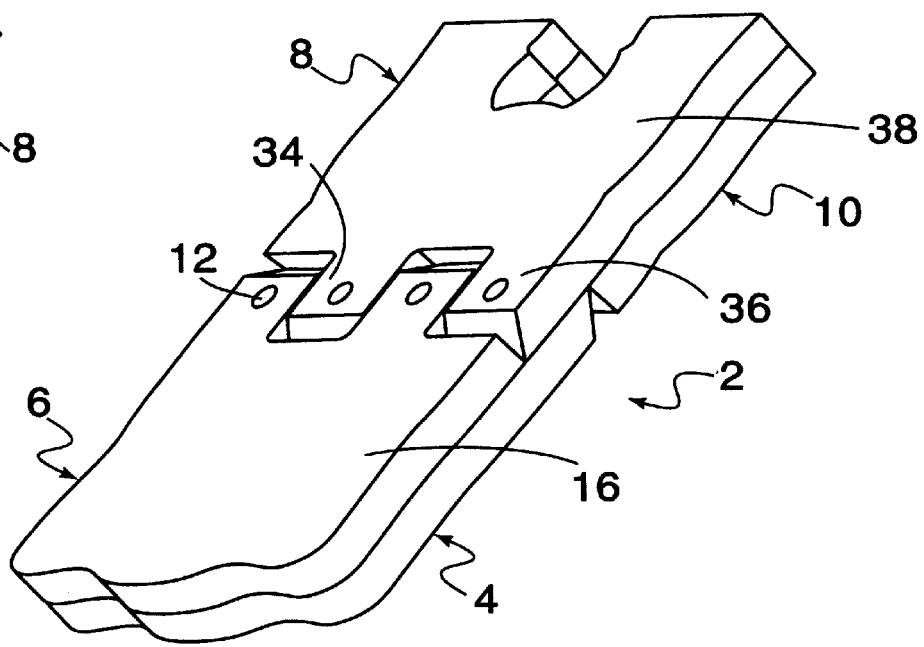
FIG. 3 is a perspective view showing the foldable bookstand in the folded position.
Figure 4:
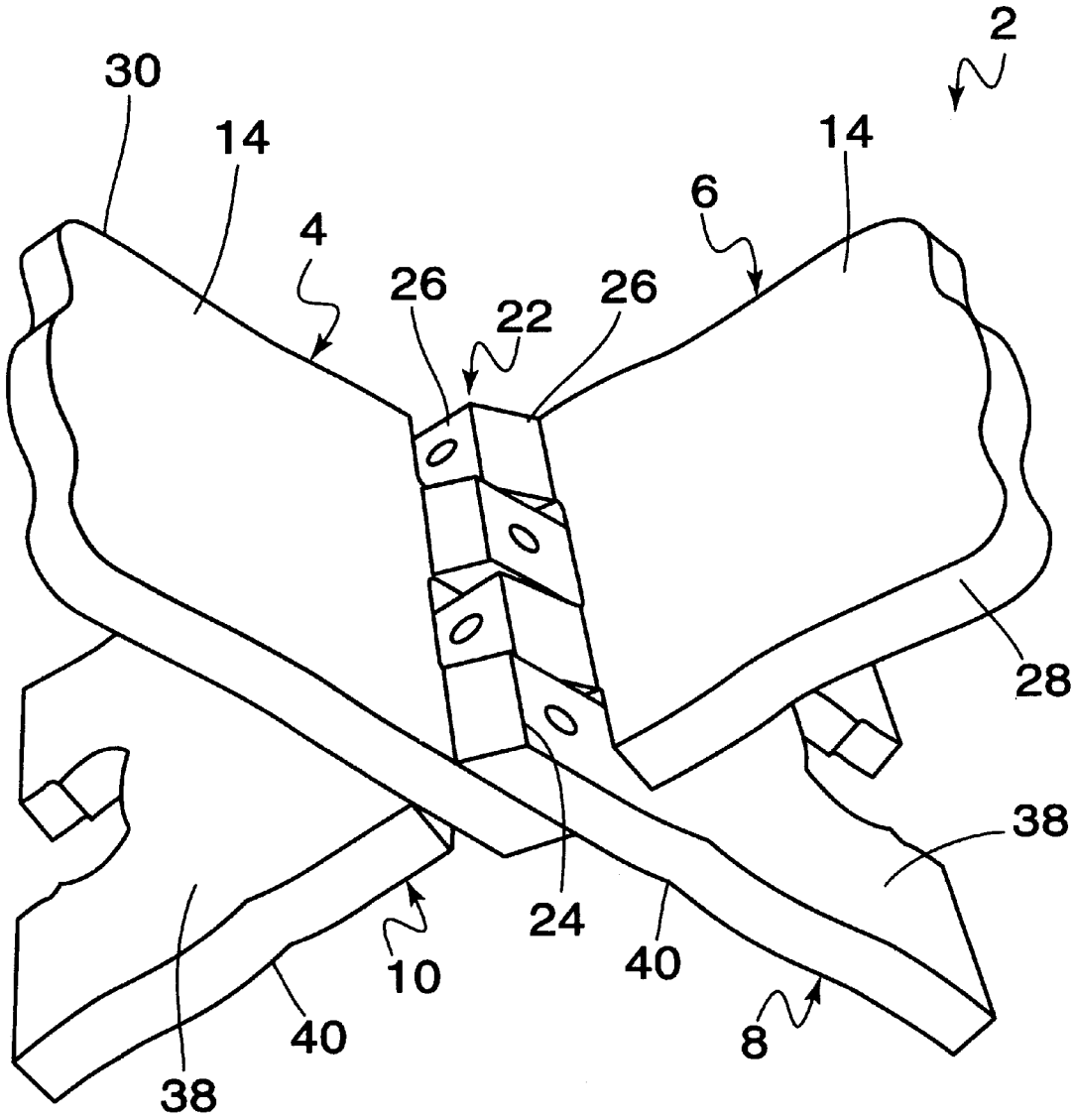
FIG. 4 is a perspective view showing the foldable bookstand in the open position.

The bookstand 2 may then be folded as shown in FIG. 3 for transportation and storage or opened to the position shown in FIG. 4 for holding a book in place in an open condition.

While the present invention has been described by reference to first matching the bottom pieces 8, 10 in a way that their back surfaces 40 abut and then attaching the appropriate top pieces 4, 6, it is clear that the top pieces 4, 6 may be matched first so that their front surfaces 14 abut and then the bottom pieces 8, 10 attached to the corresponding top pieces 4, 6.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A process of preparing a foldable, portable bookstand, which bookstand comprises two bottom pieces and two top pieces, which process comprises:

(a) obtaining first and second bottom pieces, each bottom piece having a front surface, a back surface, and two tapered extensions, (b) obtaining first and second top pieces, each top piece having a front surface, a back surface, and two tapered extensions, (c) arranging the first and second bottom pieces so that their back surfaces abut and their extensions alternate, (d) attaching the extensions of the first top piece to the extensions of the first bottom piece and attaching the extensions of the second top piece to the extensions of the second bottom piece.

2. The process of claim 1, wherein the recited extensions have holes therethrough and attachment is made with dowels.

3. A process of preparing a foldable, portable bookstand, which bookstand comprises two bottom pieces and two top pieces, which process comprises:

(a) obtaining first and second top pieces, each top piece having a front surface, a back surface, and two tapered extensions;

(b) obtaining first and second bottom pieces, each bottom piece having a front surface, a back surface, and two tapered extensions;

(c) arranging the first and second top pieces so that their front surfaces abut and their extensions alternate;

(d) attaching the extensions of the first bottom piece to the extensions of the first top piece and attaching the extensions of the second bottom piece to the extensions of the second top piece.

4. The process of claim 3, wherein the recited extensions have holes therethrough and attachment is made with dowels.

* * * * *